US007712691B2

(12) United States Patent
Sharp

(10) Patent No.: US 7,712,691 B2
(45) Date of Patent: May 11, 2010

(54) WOOD HOGGING APPARATUS

(76) Inventor: Rodney Warwick Sharp, 23 Thompson Ave., Hamilton 2001 (NZ)

( * ) Notice: Subject to any disclaimer, the term of this patent is extended or adjusted under 35 U.S.C. 154(b) by 380 days.

(21) Appl. No.: 10/594,582

(22) PCT Filed: Mar. 29, 2005

(86) PCT No.: PCT/NZ2005/000059

§ 371 (c)(1),
(2), (4) Date: Aug. 9, 2007

(87) PCT Pub. No.: WO2005/092509

PCT Pub. Date: Oct. 6, 2005

(65) Prior Publication Data

US 2008/0099592 A1 May 1, 2008

(30) Foreign Application Priority Data

Mar. 29, 2004 (NZ) ..... 532002

(51) Int. Cl.
*B02C 19/00* (2006.01)

(52) U.S. Cl. ..... 241/65; 241/74; 241/298

(58) Field of Classification Search ..... 241/73, 241/74, 81, 65, 101.76, 298
See application file for complete search history.

(56) References Cited

U.S. PATENT DOCUMENTS 4,009,834 A * 3/1977 Hahn et al. ..... 241/27
5,794,865 A * 8/1998 Didion et al. ..... 241/74

FOREIGN PATENT DOCUMENTS

DE 3808059 * 11/1988

* cited by examiner

*Primary Examiner*—Mark Rosenbaum
(74) *Attorney, Agent, or Firm*—Young & Thompson

(57) ABSTRACT

A hogging, sometimes known as reducing, apparatus for reducing wood waste into hog fuel, though some embodiments may also be used for reducing other materials including demolition timber, demolition masonry, mild steel scrap (thin sections), soft metal scrap, recycled cans, recycled glass, recycled plastic, soft rocks, occasionally hard rocks, recycled roading and asphalt, old tyres, and certain green garden waste. The apparatus includes a drum (40) inclined to the horizontal and into which raw material can be fed at its upper end. Rotation of the drum (40) assists driving raw material towards reducing elements (45) positioned at an angle near its (40) lower end. Screening apertures (41) allow sufficiently comminuted material to pass therethrough for removal. Optional features include internal agitators (60) for improving processing and screening, assisted drying of raw material by motor exhaust (71), and initial pre-screening of foreign material.

29 Claims, 10 Drawing Sheets

PRIOR ART

WOOD HOGGING APPARATUS

FIELD OF INVENTION

The present invention is directed towards hogging apparatus. This is typically apparatus for reducing the size of waste wood and timber material for use as a combustible fuel source. However additional uses include breaking down and chipping rocks, demolition materials, recycled roading, tyres, green plant matter and other materials.

BACKGROUND DESCRIPTION

The present invention is directed primarily to apparatus commonly referred to as wood hoggers, or reducers. Typically these comprise apparatus for reducing or comminuting wooden material into smaller sized pieces. Typically the raw feed material is waste pieces of logs, timber, or other wood based material which can then be converted into a combustible fuel source suitable for use in boilers, and the like, and which is commonly known as hog fuel. In practice, however, operators have been used to reduce a variety of different types of materials, such as will be discussed later.

'Hog fuel' is a combustible solid fuel often used in boilers and which is primarily made up of wood residue from sawmills, logging operations, and various wood off-cuts. Hog fuel typically varies from chipped wood as it commonly may comprise timber of a variety of sizes rather than substantially uniform chips of wood. Typically hog fuel may comprise pieces of wood typically 50 mm×50 mm×120 mm down to sawdust. It is commonly made from product which would otherwise be dumped, and may contain a significant amount of foreign materials such as dirt, and stones, depending on the source of the material and how well the material is screened prior to processing.

The machines used to prepare hog fuel are commonly known as 'hoggers' and may also be called reducers, the latter being a term more commonly used on some types of design, or as a preferred name in different regions. For the purpose of the prior art description we shall use the term 'hogger' to also include 'reducer' unless a distinction is otherwise made.

Quite a number of different sizes of hogger exist, and in most case rely on rotating reducing discs or drums with chipping or cutting teeth or features. In most instances these are used in conjunction with a grate which screens reduced material suitable for hog fuel away from product which has not yet been sufficiently reduced. Most designs have a number of flaws or problems associated with them, which at least partially counts for the presence of a number of substantially different standard designs available on the market.

A common problem that affects most designs is energy consumption. The process of reducing timber product into smaller reduced pieces suitable for hog fuel consumes a significant amount of energy, and consideration needs to be given to the economy of the process to ensure that the energy expended does not exceed the resulting energy which can be obtained from what is essentially a low-grade fuel. While this can be partially offset by the fact that hogging is also effectively removing a waste product, by recycling, the economy of the process remains very important. In a number of instances the specific design of the hogging apparatus has a bearing on energy efficiency. These problems will be detailed more fully below.

In the art a variety of different types of hogging apparatus are known, each of which have a number of disadvantages associated with them which affect their efficiency, safety, or ability to process a wide range of material. The common types of hogging apparatus known to the inventor will now be described.

Traditionally, devices known in the United States as reducers were used. One design is illustrated in FIGS. 1*a* and 1*b*. This basically comprises a horizontally rotating drum (1) with a plurality of teeth (2) distributed thereabout. Shielding the majority of the outer face of the drum is a screen grate (3) which allows processed material of suitably small size to pass therethrough, as well as acting as a safety shield. Positioned in proximity to the teeth of the rotating drum are one or more anvils (4) whose distance of separation from the teeth (2) largely determines the size of the resulting material. As raw material is fed into the apparatus (generally indicated in direction by arrow (5)), the teeth basically mash wood against the anvil and break it down into a reduced size reflecting a distance of the anvil from the teeth. This material is largely carried through an exit via the grate (3).

However, this design suffers from high energy usage and substantial wear on the teeth and anvil. More significantly however, materials such as steel, metal, and very hard rocks can basically jam the system. A typical result is either shearing of the teeth from the drum, or damage to other components. This catastrophic destruction of components can be expensive and time consuming to fix. Given that a lot of forestry material may contain steel pins from logging trucks, or other hard foreign material, this type of apparatus either needs to be precluded from processing such materials, or the raw material subjected to additional time consuming, and potentially expensive, cleaning steps. Given that the hog fuel is a low grade and inexpensive fuel, expensive cleaning steps cannot normally be justified. The high energy usage of this type of apparatus also reduces any profit margin which may be gained from the production of hog fuel.

Additionally, as timber may come from a variety of sources including demolition materials, this type of apparatus also suffers another type of problem related to stringy material. When material such as flax, long fibrous leaves, or carpet are fed into the system, the grate becomes quickly clogged and the machine stalls as material then becomes wound around the drum. Such material can stall this type of apparatus in as little as three seconds, and may require several hours for it to be pulled apart and fixed.

In another type of apparatus a horizontally rotating drum is placed at the bottom of a shallow pan. The drum occupies an aperture in the base of the pan, and the material is substantially gravity fed towards the rotating drum. Additionally or alternatively the pan itself may also rotate. This arrangement is shown generally in FIGS. 2*a-c*.

Processed material exits through a grate (20) covering the portion of the drum (21) positioned below the pan (22). Material too large to pass through the grate (20) is generally returned to the pan and eventually comes once again into contact with the rotating drum. In this type of apparatus there is no anvil, with the drum essentially nibbling at the material within the pan from the bottom. However this type of apparatus has a tendency to fire projectiles (such as foreign material) upwards, thus introducing safety issues. It will effectively eat and nibble away at just about anything though is even more susceptible to steel, and also suffers problems with stringy materials. There is also a very high energy usage for this type of apparatus.

Another variation is a tub-type hogger where a horizontal disc is positioned near the bottom. This disc has teeth about its outer peripheral and also on its top, and sometimes bottom, surfaces. This is generally shown in FIG. 3*a-b*. In this type of hogger either the disc (30) can rotate, and/or the tub (3) may rotate around the disc, ensuring relative motion of the raw material which is held within the tub with respect to the disc. The bottom of the tub is essentially a grate (32) which allows processed material of sufficiently reduced size to fall free from the bottom. While this design is less likely to fire high speed projectiles, and is also more tolerant of hard materials such as metal and steel etc, it does suffer from high wear as the raw material is in contact with the rotor all of the time. This continuous contact also reduces energy efficiency and the apparatus requires significant amount of power in order to operate. Further, it has been found that the screening in this type of apparatus can be inconsistent and it depends largely on the amount of material which is in the tub at any one time—for instance, a low load can allow big pieces to pass through while a high load (i.e. lots of material in the tub) may only let much smaller material out. In this type of apparatus energy efficiency is very much dependent on maintaining optimum fill rates. Overfilling tends to create a situation where little screening occurs, or only in the vicinity of the rotating disc. In such cases there is also a tendency for already reduced material to keep being reintroduced to the disc, resulting in poor energy efficiency and high tooth wear in terms of throughput. The design is also susceptible to green plant material, which tends to clog the screen except in close proximity to the rotating disc. The resulting significant reduction in screen area seriously effects throughput and efficiency.

The fourth type of hogger in usage, though which is relatively uncommon, is like a chipper. It has a rotating disc in which bulk unprocessed material is fed to interact with the top rotating surface. This type of apparatus is very efficient, though is restricted to only processing full stems of material. There is also very high blade wear and it is also very susceptible to steel and metal. This type of hogger is typically restricted only for uses where trees are specially grown for fuel, and introduces the added requirement that felled logs must be handled very carefully to avoid picking up rocks or other foreign material which could damage the apparatus.

As can be seen from the above description, quite a range of approaches have been proposed for producing hog fuel. However each one of these designs suffers from one or more disadvantages which are commonly related to safety issues, durability and maintenance of the apparatus, and efficiency of production. From an economical perspective, given the low value of hog fuel, there is a requirement that hog fuel must be produced efficiently and at low cost, and that maintenance and repair costs cannot be to the extent they substantially impact on the profitability of the process.

Therefore there is a need for an alternative process which can provide an efficient means for producing hog fuel, and which ideally is able to process a wide range of materials.

It has also been previously mentioned that hoggers have also been used to process a variety of other materials, and appear to be advancing into a role as a recycling machine. The type of materials being reduced depends very much on hogger design, though known uses include the reduction of: demolition timber, demolition masonry, mild steel scrap (thin sections), soft metal scrap, recycled cans, recycled glass, recycled plastic, soft rocks, occasionally hard rocks, recycled roading and asphalt, old tyres, green garden waste, etc. As can be appreciated from the above description, a majority of these materials would be fatal to a number of known hogger and reducer designs. These materials can also exacerbate many of the problems previously mentioned and thus potentially useful and valuable recycling apparatus is often precluded from widespread use in these additional roles.

It is therefore an object of the present invention to propose apparatus which represents an alternative and efficient means of producing hog fuel from a range of wood based materials.

It is an object of the present invention to consider an improved design which lends itself to the processing of materials other than typical forestry and timber materials traditionally used in hoggers.

It is an alternative object of the present invention to provide apparatus which addresses one or more of the problems affecting the prior art.

At the very least it is an object of the present invention to provide the public with a useful choice.

Aspects of the present invention will be described by way of example only and with reference to the ensuing description.

GENERAL DESCRIPTION OF THE INVENTION

According to one aspect of the present invention there is provided hogger apparatus comprising:

a drum inclined to the horizontal, being substantially open at the upper end to allow the feed of raw material therein, and including a rotating reducing means within and proximate the lower end of the drum, said reducing means bearing a plurality of features which interact and reduce the size of raw material with which it comes into contact;

the arrangement being further characterised in that at least a portion of the drum exhibits a plurality of apertures acting as screening apertures to allow processed material of sufficiently reduced size to pass therethrough.

According to another aspect of the present invention there is provided hogger apparatus, substantially as described above, in which the drum is rotatable.

According to another aspect of the present invention there is provided hogger apparatus, substantially as described above, in which rotation of the drum may be stopped while processing of raw material proceeds.

According to another aspect of the present invention there is provided hogger apparatus, substantially as described above, in which the reducing means is substantially a disc in shape.

According to another aspect of the present invention there is provided hogger apparatus, substantially as described above, in which the rotational axis of the disc is angled, when the apparatus is viewed in top plan, at an angle to the longitudinal axis of the drum.

According to another aspect of the present invention there is provided hogger apparatus, substantially as described above, in which the angle of the disc's rotational axis relative to the drum's longitudinal axis, when viewed in plan, is within the inclusive range of 5°-75°.

According to another aspect of the present invention there is provided hogger apparatus, substantially as described above, in which the angle of the disc's rotational axis relative to the drum's longitudinal axis, when viewed in plan, is within the inclusive range of 25°-45°.

According to another aspect of the present invention there is provided hogger apparatus, substantially as described above, in which the rotational axis of the disc is angled, when the apparatus is viewed from the front, at an angle to the longitudinal axis of the drum.

According to another aspect of the present invention there is provided hogger apparatus, substantially as described above, in which the angle of the disc's rotational axis relative to the drum's longitudinal axis, when viewed from the front, is within the inclusive range of 5°-75°.

According to another aspect of the present invention there is provided hogger apparatus, substantially as described above, in which the angle of the disc's rotational axis relative to the drum's longitudinal axis, when viewed from the front, is within the inclusive range of 25°-45°.

According to another aspect of the present invention there is provided hogger apparatus, substantially as described above, in which the angle of the disc's rotational axis relative to the drum's longitudinal axis, when viewed from the front, is downward from the longitudinal axis when travelling from the end of the drum where the disc is located and towards the alternate feed end of the drum.

According to another aspect of the present invention there is provided hogger apparatus, substantially as described above, in which the disc rotates in a direction opposite the direction of rotation of the drum.

According to another aspect of the present invention there is provided hogger apparatus, substantially as described above, in which, when viewed from an end of the drum, the disc is offset with respect to the longitudinal axis of the drum.

According to another aspect of the present invention there is provided hogger apparatus, substantially as described above, in which, when viewed from the end of the drum, the disc is offset to the left or right with respect to the longitudinal axis of the drum.

According to another aspect of the present invention there is provided hogger apparatus, substantially as described above, in which the features on the reducing assembly for reducing the raw material are teeth.

According to another aspect of the present invention there is provided hogger apparatus, substantially as described above, in which the teeth are replaceable.

According to another aspect of the present invention there is provided hogger apparatus, substantially as described above, in which the drum is substantially cylindrical.

According to another aspect of the present invention there is provided hogger apparatus, substantially as described above, in which the drum is of substantially constant diameter along its length.

According to another aspect of the present invention there is provided hogger apparatus, substantially as described above, in which the screening apertures are present over substantially the entire outer surface of the drum, at least between the reducing means and the feed end of the drum.

According to another aspect of the present invention there is provided hogger apparatus, substantially as described above, in which the screening apertures are provided by replaceable screen sections attached to a framework of the drum.

According to another aspect of the present invention there is provided hogger apparatus, substantially as described above, in which differently sized screening apertures are provided on the drum.

According to another aspect of the present invention there is provided hogger apparatus, substantially as described above, in which the drum is divided into at least two sections, with an inwardly directed flange extending from the inner wall of the drum defining the boundary between different adjacent sections.

According to another aspect of the present invention there is provided hogger apparatus, substantially as described above, in which a first of said two sections adjacent the feed end of the drum is a cleaning section, and the other section, in which the reducing means is present, is a processing section for the reduction of introduced material; the inward flange acting as a barrier affecting the passage of small material from the first to the second processing section.

According to another aspect of the present invention there is provided hogger apparatus, substantially as described above, in which said small material is typically stones, dirt, and foreign material.

According to another aspect of the present invention there is provided hogger apparatus, substantially as described above, in which the cleaning section pre-screens introduced raw material from the feed end to separate stones, dirt, and foreign material therefrom.

According to another aspect of the present invention there is provided hogger apparatus, substantially as described above, in which screening apertures are present on the drum in the first cleaning section, the size of screening apertures on the cleaning section being smaller than the average size of those present on the processing section.

According to another aspect of the present invention there is provided hogger apparatus, substantially as described above, in which the cleaning section includes one or more agitating means.

According to another aspect of the present invention there is provided hogger apparatus, substantially as described above, in which the configuration and operation of the agitating means is such to knock or wipe small foreign material from bulk introduced raw material in the cleaning section.

According to another aspect of the present invention there is provided hogger apparatus, substantially as described above, in which there is external wiping or brushing means for assisting the clearing and unblocking of foreign material from the screening apertures.

According to another aspect of the present invention there is provided hogger apparatus, substantially as described above, in which there is provided, adjacent the internal face of the drum, at least one rotating agitator to increase turbulence of the bulk raw and processed material in its vicinity.

According to another aspect of the present invention there is provided hogger apparatus, substantially as described above, in which the rotating agitator is configured and operated to enhance screening efficiency by varying the position and/or orientation of bulk material with which it interacts.

According to another aspect of the present invention there is provided hogger apparatus, substantially as described above, in which a rotating agitator is basically a rotating shaft with a screw blade thereabout.

According to another aspect of the present invention there is provided hogger apparatus, substantially as described above, in which the shaft with screw blade is rotated such that the screw blade will attempt to push bulk material towards the feed end of the drum.

According to another aspect of the present invention there is provided hogger apparatus, substantially as described above, in which a rotating agitator comprises a shaft with paddles or blades mounted or formed thereon.

According to another aspect of the present invention there is provided hogger apparatus, substantially as described above, in which there is also provided at least one motive means for rotating the drum and reducing means.

According to another aspect of the present invention there is provided hogger apparatus, substantially as described above, in which the motive means is a hydraulic motor.

According to another aspect of the present invention there is provided hogger apparatus, substantially as described above, in which the pump for the hydraulic motor is powered by a combustion engine.

According to another aspect of the present invention there is provided hogger apparatus, substantially as described above, in which the motive means is a hydraulic motor.

According to another aspect of the present invention there is provided hogger apparatus, substantially as described above, in which the exhaust from the combustion engine is vented into the interior of the drum to heat, and partially dry, introduced raw material.

According to another aspect of the present invention there is provided hogger apparatus, substantially as described above, in which the exhaust is introduced by a pipe with venting apertures therein, which extends along at least part of the length of the drum.

According to another aspect of the present invention there is provided hogger apparatus, substantially as described above, in which a significant proportion of exhaust is vented into the drum near the feed end thereof.

According to another aspect of the present invention there is provided hogger apparatus, substantially as described above, in which there is an associated feed mechanism for delivering raw material into the drum.

According to another aspect of the present invention there is provided hogger apparatus, substantially as described above, in which the feed mechanism is a conveyer arrangement.

According to another aspect of the present invention there is provided hogger apparatus, substantially as described above, which includes clearing means for transporting screened material away from the apparatus.

According to another aspect of the present invention there is provided hogger apparatus, substantially as described above, in which the clearing means comprises conveying means able to deliver transported material into a hopper, trailer, or storage area.

According to another aspect of the present invention there is provided hogger apparatus, substantially as described above, which includes both conveying feed means for introducing raw material into the drum, and clearing means; the conveying feed means positioned to be substantially over lower clearing means.

According to another aspect of the present invention there is provided hogger apparatus, substantially as described above, in which the raw material is predominantly wood based.

According to another aspect of the present invention there is provided hogger apparatus, substantially as described above, in which the raw material is predominantly one or more of the following: demolition timber, demolition masonry, mild steel scrap (thin sections), soft metal scrap, recycled cans, recycled glass, recycled plastic, soft rocks, occasionally hard rocks, recycled roading and asphalt, old tyres, green garden waste.

According to another aspect of the present invention there is provided hogger apparatus, substantially as described above, which is mounted on to a trailer or vehicle.

Hogger apparatus according to the present invention typically comprises a drum. This drum is preferably substantially cylindrical or barrel-like in appearance and allows a quantity of raw unprocessed material to be held at any given time. The preferred shape of the drum is cylindrical with substantially constant diameter along its length. However this does not preclude other designs, providing that the drum is generally cylindrical or barrel like in overall appearance, and can perform the desired operations of the present invention.

The shape of the drum should be such as to allow introduced raw material to be fed towards reducing means which is responsible for breaking down the raw material into smaller sized pieces. To achieve this the drum is generally inclined with respect to the horizontal such that the longitudinal axis of the drum is typically inclined at an angle within the inclusive range 5°-45° (of the horizontal), and more preferably within the inclusive range of 15°-30°. The direction of inclination is such that a first end of the drum, which is typically open and represents a means for raw material to be fed into the drum, is at the upper end, while the reducing means (which is positioned at or near the other end of the drum), is at the lower end. As in most embodiments the drum rotates about its longitudinal axis, this inclination is effective for gradually progressing raw material from the feed end towards the reducing means.

It will also be seen later that not all material will be sufficiently reduced in size when it first makes contact with reducing means. Accordingly some of this material will be thrown at least partially back up the drum, where the drum's inclination will result in it being gradually re-fed to the reducing means.

The drum typically also has a plurality of apertures about its body which act as a screening apertures to allow sufficiently small materials to pass therethrough. The size of these apertures may be substantially constant, though they may also very in size according to various distribution patterns about the apparatus. For instance, the size of the apertures may reduce as one progresses towards the feed end, allowing for smaller reduced material which may be thrown further up the apparatus to be removed from within the drum as soon as possible. The size, variations, and distribution patterns of the screening apertures will to a large effect be dependent on user choice, and influence the average sized material which will be removed from the system.

The apertures may be present on attachable screen sections, which are attached to a framework for the drum. This not only facilitates manufacturing and construction, but removable screen sections allow their removal for shipping, maintenance, and substitution with sections having different aperture sizes or distributions.

The drum is preferably driven to be able to rotate, though the invention does include lesser preferred options where there is no rotation. It is envisaged that these embodiments are likely to rely more on agitation means to shift raw material within the inclined drum. A preferable alternative is for embodiments having rotatable drums to provide the option of stopping the drum during processing. A further option is to allow reverse rotation of the drum.

While the reducing means may take a number of different forms (including rotating drums), the preferred arrangement is a rotating disc. Ideally this has a plurality of teeth or projections on its exposed front face though will typically also comprise teeth or other projections about its circumferential edge, and possibly also behind. Accordingly, a majority of the processing of raw material will be performed preferentially by the front face, though the circumferential edge will also perform significant processing on some of the raw material.

The rotation of reducing means taking the form of a disc may vary according to user choice. There may be some advantage in directing the rotational direction opposite to that of the drum (in rotatable embodiments) so as more forcefully interact with raw material being rotated and driven towards it. Additionally it can be more likely to throw material back up the drum where it may be more effectively screened by apertures not obscured by a build up of raw unprocessed material. Larger material will also be represented to the rotating disc in a different orientation, which may improve processing efficiency.

In preferred embodiments of the present invention the disc is also angled in a number of ways. When the apparatus is viewed from above, the disc may be angled with respect to the longitudinal axis of the drum. In a preferred embodiment the difference in the rotational axis of the disc to the longitudinal axis of the drum is within the inclusive range of 5° through 75°. More preferably, in preferred embodiments, this difference is within the inclusive range of 25° through 45°.

The disc may also be inclined in other directions as well. For instance if one viewed the hogger apparatus from the front, such that we are viewing the side of the drum rather than an end thereof, the disc may also be inclined relative to the longitudinal axis of the drum. The difference between the rotational axis and longitudinal axis may again be within the inclusive range of 5° through 75° inclusive, though more preferably within the smaller inclusive range of 25° through 45°. Ideally, when viewed from the front, an inclined disc will be such that its lower most edge is closer to the open feed end of the drum than will be its topmost edge.

These modifications are considered to improve the efficiency of the apparatus, though need not be employed in every embodiment. It was considered that a major problem relating to the wear and efficiency in some of the prior art designed resulted from the rotating disc or reducing means being totally and continually covered with bulk material to be processed. This constant contact, which included contact with both unprocessed material, and material yet waiting to be screened, substantially reduced efficiency and imposed quite high requirements on the amount of power required to drive the disc or drum. By appropriately angling and positioning the disc it is envisaged that only a portion of the disc will be presented in any one time (unless drum is overloaded) with raw material waiting to be processed, then at least a portion of partially processed material will be flung further back up the drum where it has the opportunity to be screened before being reintroduced to the rotating disc.

As wear can still be high, particularly when processing raw materials which are predominantly other than wood, the use of a disc having replaceable teeth may be advantageous.

Other improvements have been proposed to hogger apparatus according to the present invention. For instance, it has been considered to include agitating means which increases the agitation of bulk material in the vicinity of the screen. Typically this may be achieved by including a rotating element which basically creates turbulence so that material in the vicinity of the screen may be tumbled, re-orientated, and presented to the screening apertures in different orientations. This agitation may also allow sufficiently reduced material, able to pass through the screening apertures, to be presented to the screening apertures in the instance they might otherwise have been blocked from contact with same by material that was too large in size. Accordingly, it is considered that introducing agitating means can improve the efficiency of the screening process, which in turn affects the efficiency of the overall process.

Agitating means may be introduced in a number of ways. A simple method is to provide a shaft with a helical screw or blade passing about its outer face. Rotating this screwed shaft can effectively introduce some turbulence. Ideally the direction of rotation is such that the screw will be attempting to drive material back up the drum and away from the reducing means. This further prolongs the period during which the material is able to be exposed to a screening process before being reintroduced to the reducing means.

Other designs may also be adopted for agitating means. Different shaft designs bearing blades, paddles and other mechanical equipment may also be considered. However the main object of the agitation means remains the same, to improve the efficiency of the screening process ideally by introducing turbulence and agitation in the vicinity of the screening apertures.

More than one agitation means may be provided in the apparatus though it is considered that economy and efficiency favours the use of one suitably positioned agitation means, ideally positioned so as to interact with a significant proportion of the material which is settling within the drum.

A further problem affecting hogging apparatus, particularly during the processing of forestry material, is the presence of foreign material. Not only does steel and rocks pose a problem, but also non-combustible material such as dirt, clay, small stones etc. A simple modification has been proposed for some embodiments which will improve the separation and removal of such material from the bulk raw material.

It is proposed that the drum is divided into sections. The manner of forming a boundary between the sections can be the presence of an inwardly directed flange extending from the inner face of the drum. This flange may be removable. The height of this flange may be relatively shallow as one does not wish to form a total dam to the progress of raw material.

Accordingly the height of the flange may only comprise 5-10% of the diameter of the drum though this may very according to the type of material typically being processed. It is envisaged in preferred embodiments that this barrier will typically be of 25-250 mm in height, and typically in the range 40-100 mm.

This sectioning into what will be conveniently described as a first initial cleaning section, and a subsequent processing section, can be further improved if agitation apparatus is introduced into the cleaning section. The agitation apparatus in the cleaning section may be more vigorous in nature and serve to knock and wipe foreign material such as dirt, small stones, and clay etc which may be attached to bulk raw material being fed into the apparatus. It is also envisaged that the inward flange will act as a barrier to prevent this removed small material from travelling into the second section while the larger bulk material will have no real difficulty in progressing through the apparatus. The majority of foreign material will then be able to exit via apertures provided in the cleaning section. These apertures may be of a smaller size than in the subsequent processing section, so as to only allow this typically smaller foreign material to pass through and to be suitably removed after exit from the apparatus.

As some of this material may be wet and sticky, and may clog screening apertures associated with the cleaning section, wiping or brush like means may be provided to help clear these first section apertures. Typically this may be provided on the outside of the apparatus for convenience, and to avoid damage thereto by the bulk material.

Typically the apparatus will require motive means to drive rotation of the reducing means and the drum. Various types of motive means, and more than one motive means, may be employed. However it is envisaged that in most cases a combustion engine, typically a diesel engine, will be relied upon to drive the apparatus This may directly drive the apparatus through suitable transmission means, or drive a hydraulic pump which powers motors driving components of the apparatus such as the disc and drum etc. When such combustion engines are used, an additional advantage may be realised. Such combustion engines have an exhaust which comprises a significant amount of heat. By suitable venting of these exhaust gases to within the interior of the drum, the bulk material can be heated. In the situation where the raw material is damp or wet, this can provide a useful drying effect which in turn increases the true calorific output of the resulting fuel, and hence its value to the operator.

Exhaust gases may be introduced in a number of ways. Perhaps the simplest way which is proposed by the inventor is to introduce a shaft from along at least part of the length of the drum and which has a number of apertures therein which allow the venting of exhaust gases inside the drum. The size and position of the exhaust gases may be varied to either give a substantially even output of exhaust gases along its route, or to concentrate the release of exhaust gases where they are able to do the most good. This may be where the greatest concentration or bulk of processed materials lies (i.e. in the vicinity of reducing means). However, in embodiments where there is a cleaning section, enhanced drying in this section may improve subsequent processing as well as improving the removal of wet dirt, clay, and similar types of foreign material.

The apparatus may also include feed means to feed raw material within the drum. In a preferred embodiment a dual conveyor system is incorporate which allows delivery of bulk material into the apparatus, as well as removal of comminuted material. Various arrangements may be considered, and may also be catered for by an independent existing conveying system.

The apparatus may be constructed to sit on the ground or, as in one embodiment to be described later, mounted on a trailer so that a mobile unit is obtained.

DESCRIPTION OF DRAWINGS

Different aspects of the invention will be described with reference to the accompanying drawings in which.

DESCRIPTION OF PREFERRED EMBODIMENT

Figure 1B:
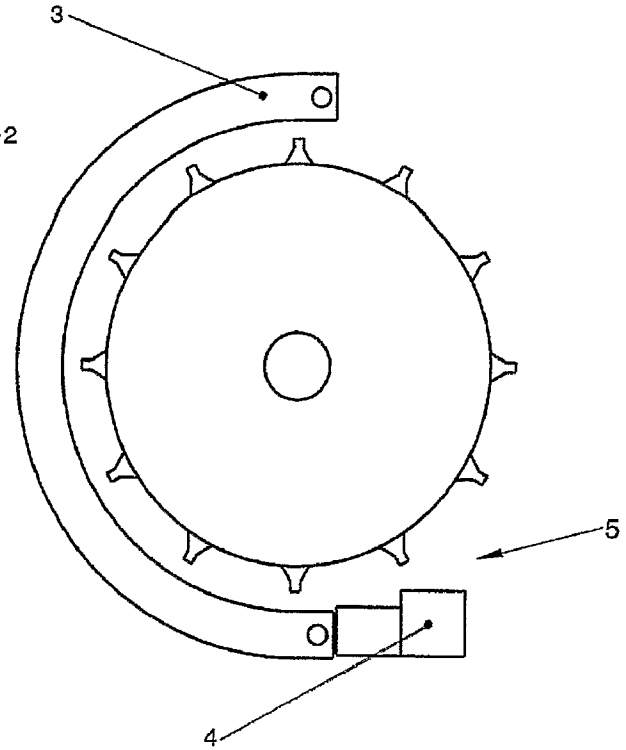
Fig 1b PRIOR ART
FIGS. 1*a, b* are perspective diagrammatic views of a typical horizontal drum hogger of the prior art.
Figure 1A:
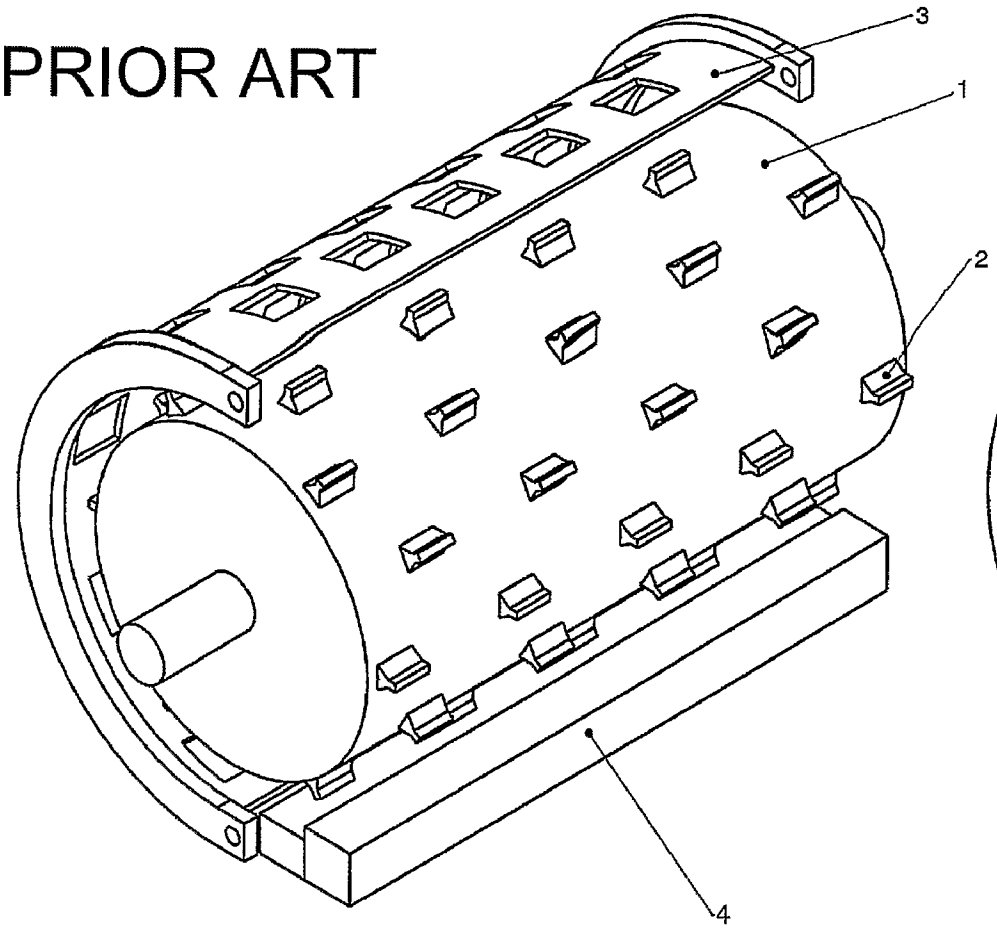
Figure 2A:
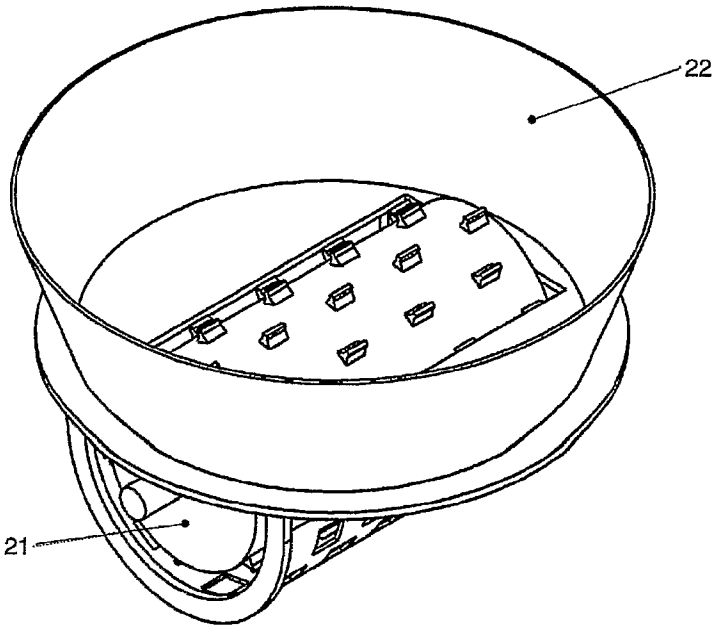
Fig 2a PRIOR ART
FIG. 2*a-c* are perspective diagrammatic views of a typical tub grinder of the prior art.
Figure 2B:
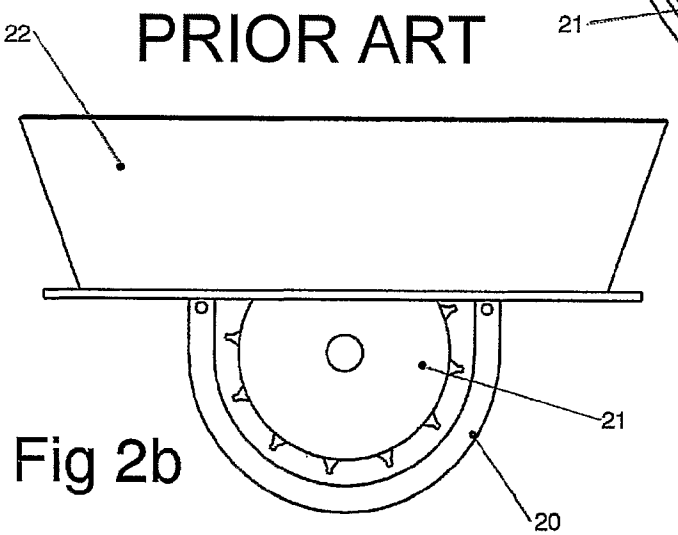
Fig 2b PRIOR ART
Figure 2C:
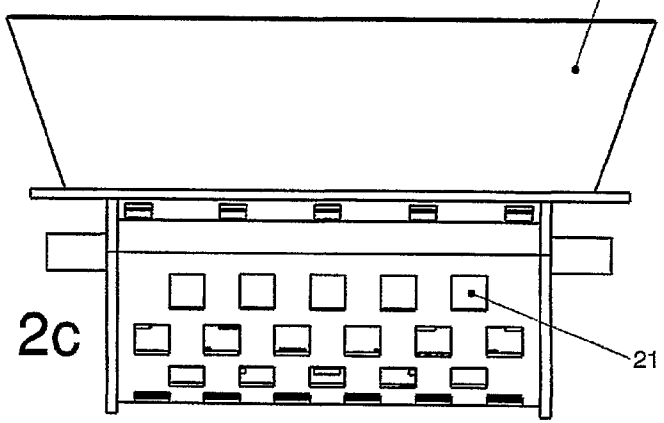
Fig 2c PRIOR ART
Figures 3A, 3B:
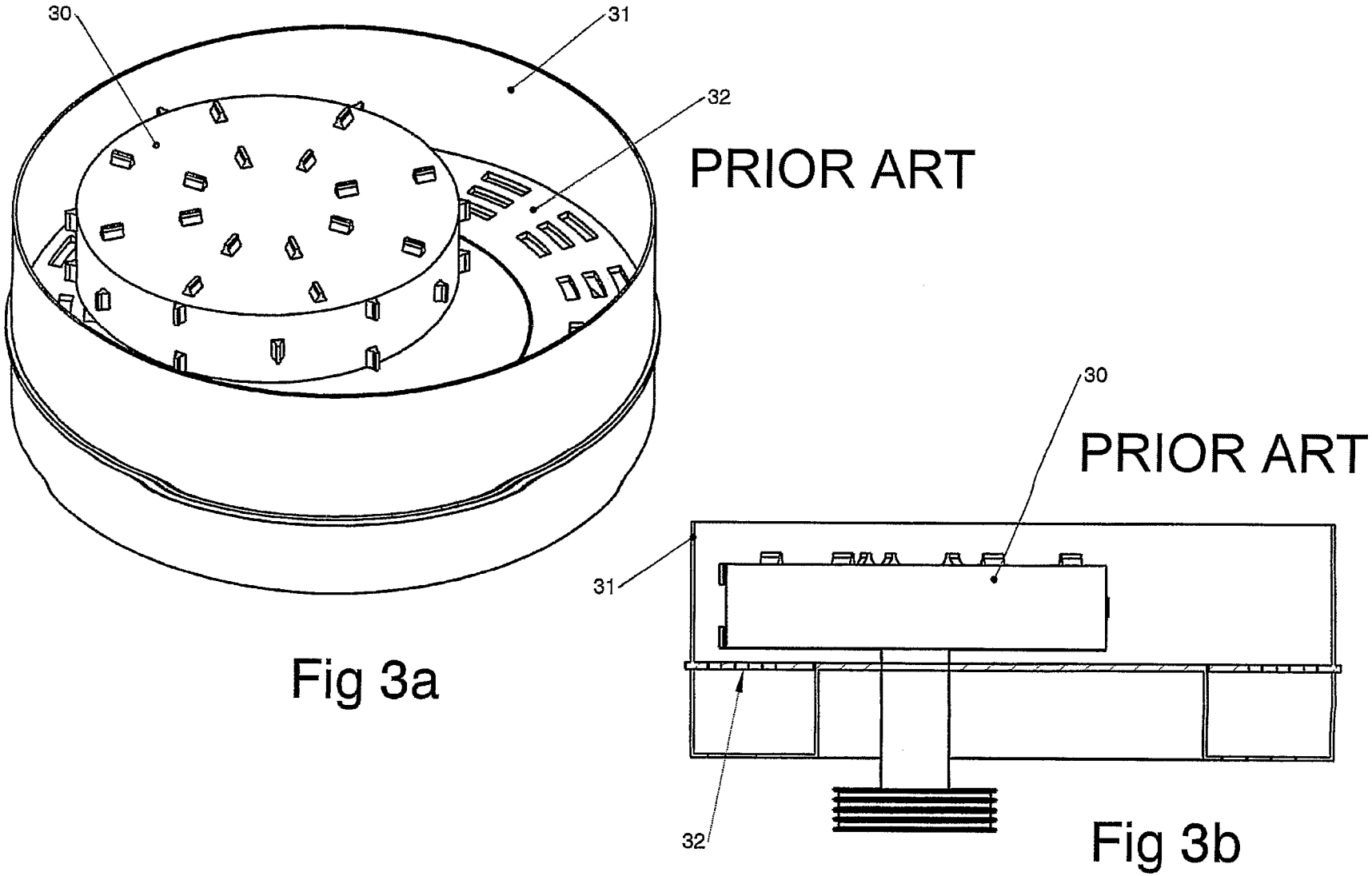
FIG. 3*a, b* are perspective diagrammatic views of a typical tub-type hogger of the prior art.
Figure 4:
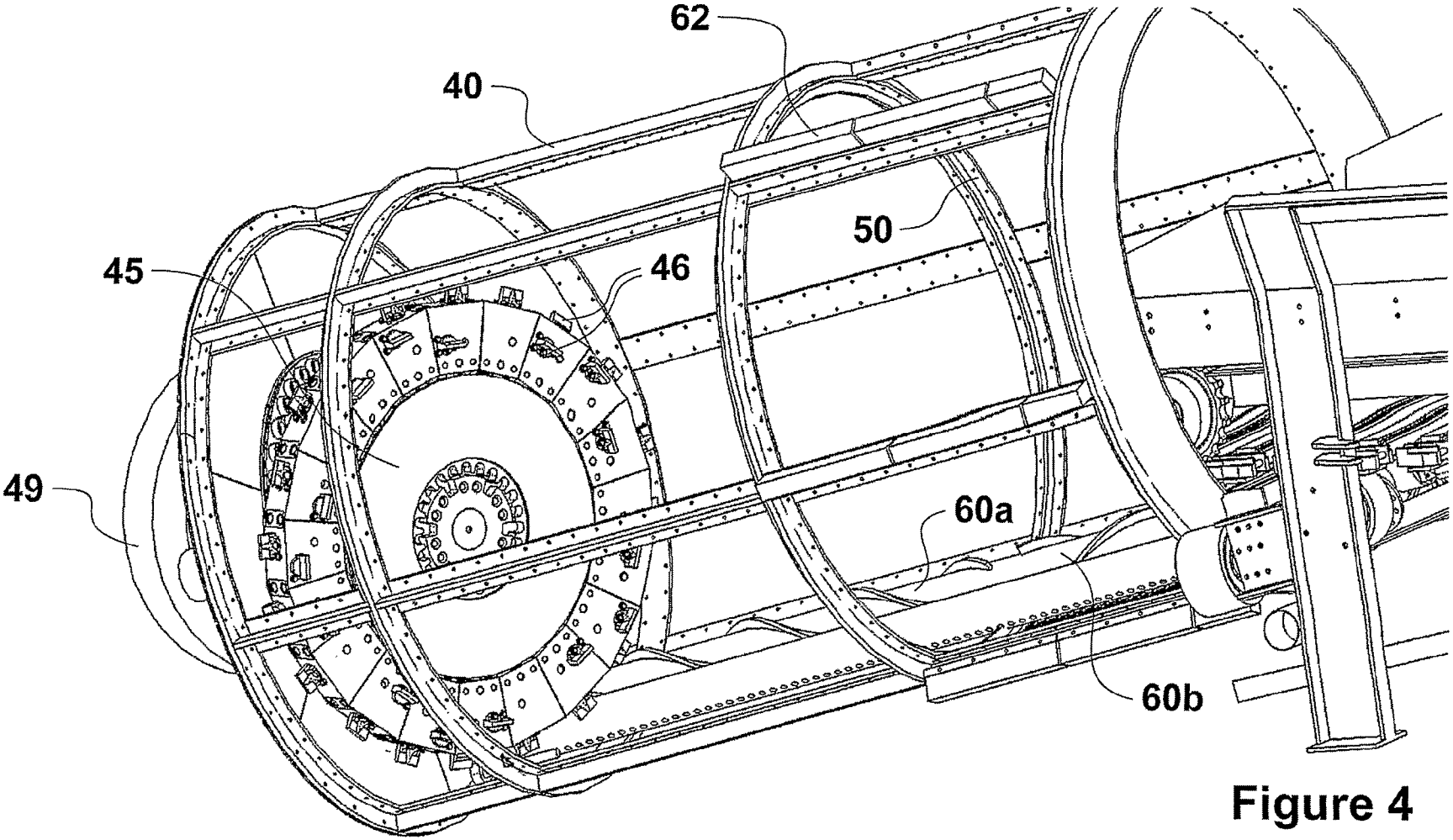
FIG. 4 is a front cut-away perspective view of the drum portion of a preferred embodiment of hogger apparatus according to the present invention.

With reference to the drawings and by way of example only there is provided hogger apparatus such is best illustrated in FIG. 4. The hogger apparatus comprises a drum, (40) which comprises a structural metal frame overlaid with a metal grate panels (41). For simplicity of viewing, the grate (41) is not shown in all of the figures. The grate is typically of a steel though other suitable materials can be substituted. The panels may be removable for repair and access to internal components of the apparatus.

Figure 5:
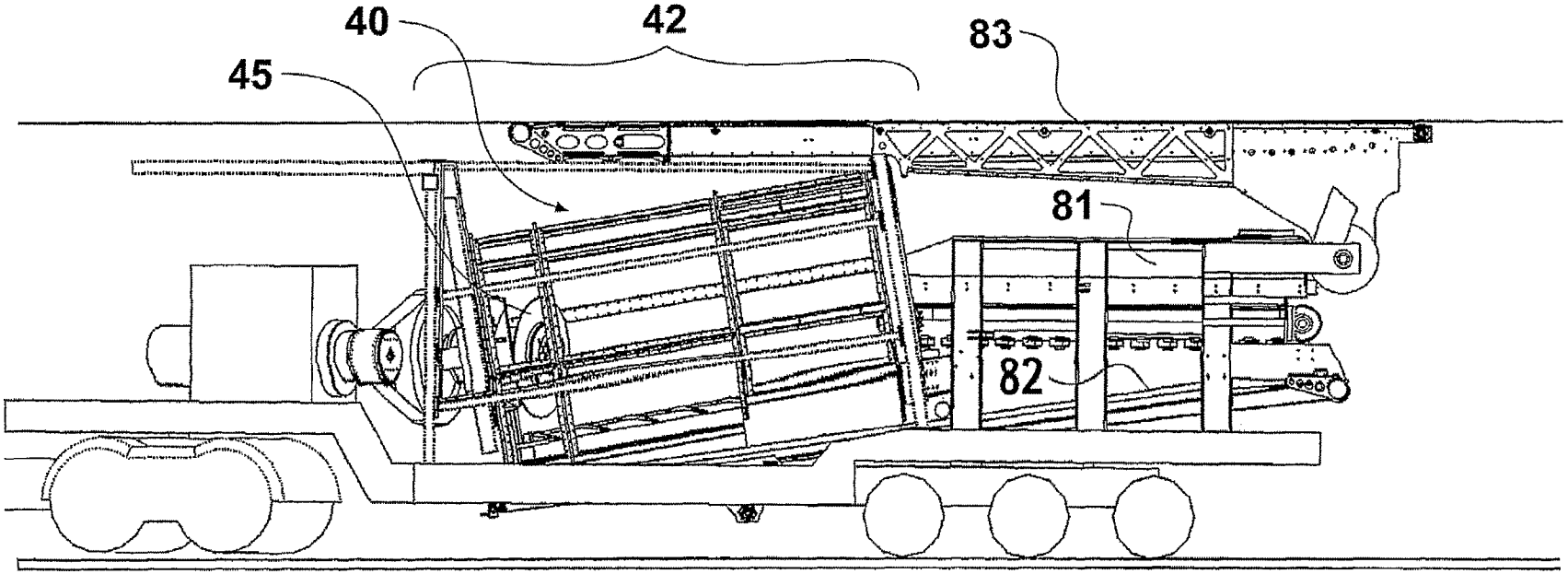
FIG. 5 is a front full view of a variation of the embodiment of FIG. 4 when mounted on a trailer, with some portions cut-away for clarity.

FIG. 5 illustrates hogger apparatus (generally indicated by section 42) as part of mobile apparatus including feed and removal means (to be discussed more fully later).

In FIG. 5 the inclination of the drum (40), from the horizontal, is shown. In this figure bulk material is fed from the right hand side into the apparatus.

Figure 6:
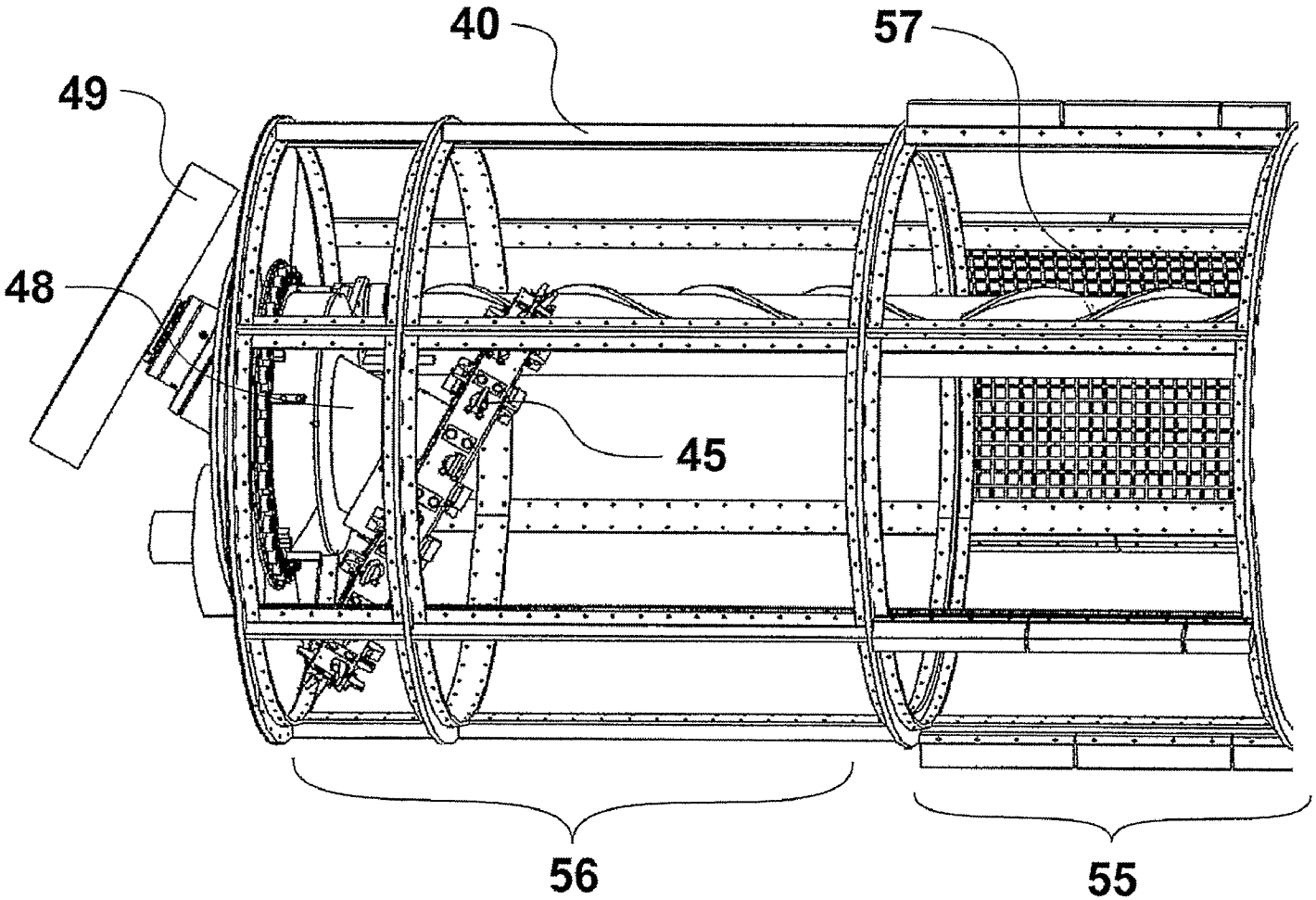
FIG. 6 is a top plan cut-away view of the drum portion of the embodiment of FIG. 4.
Figure 7:
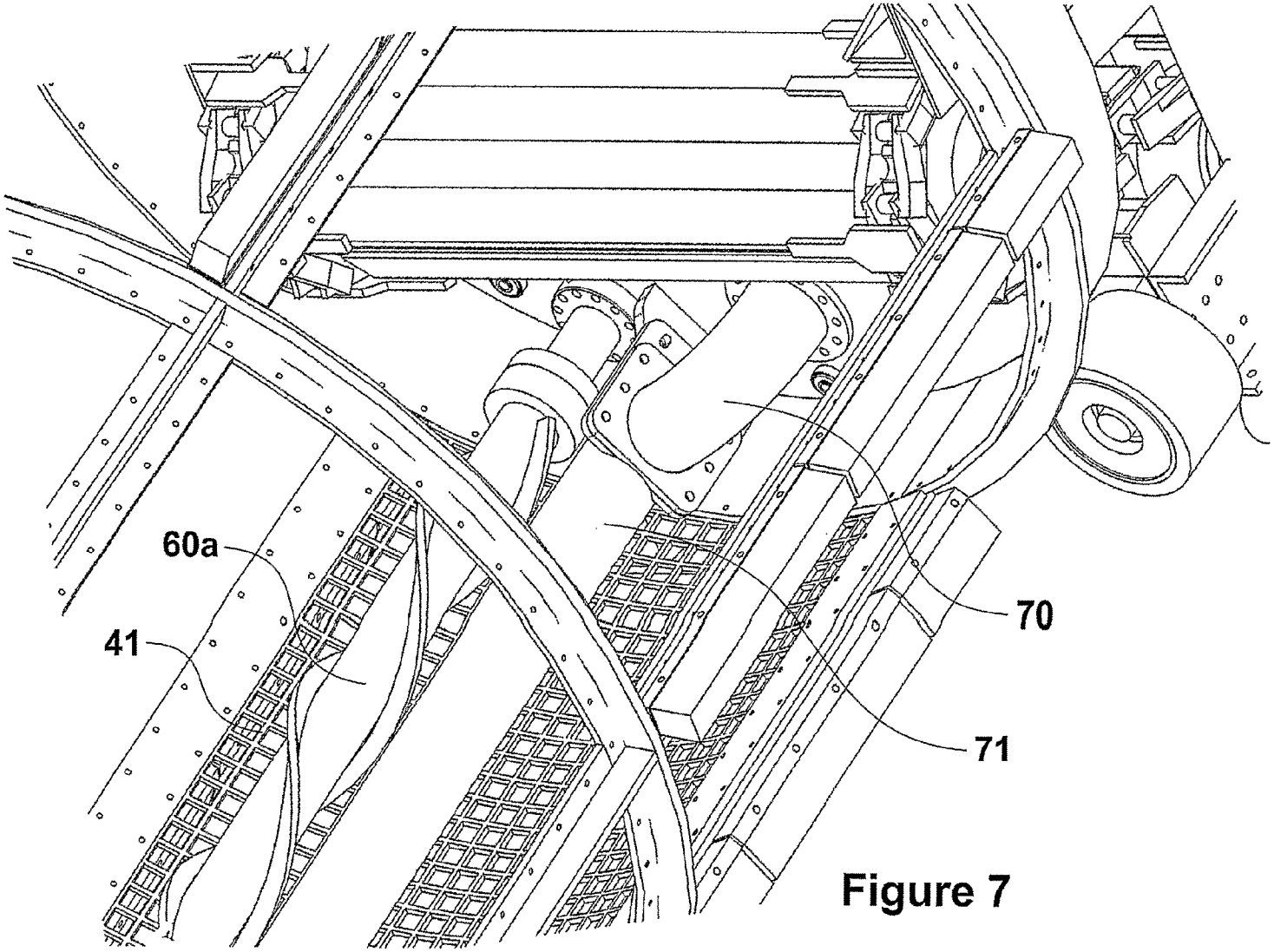
FIG. 7 is a perspective cut-away view showing detail near the lower end of the drum portion of the embodiment of FIG. 4.
Figure 8:
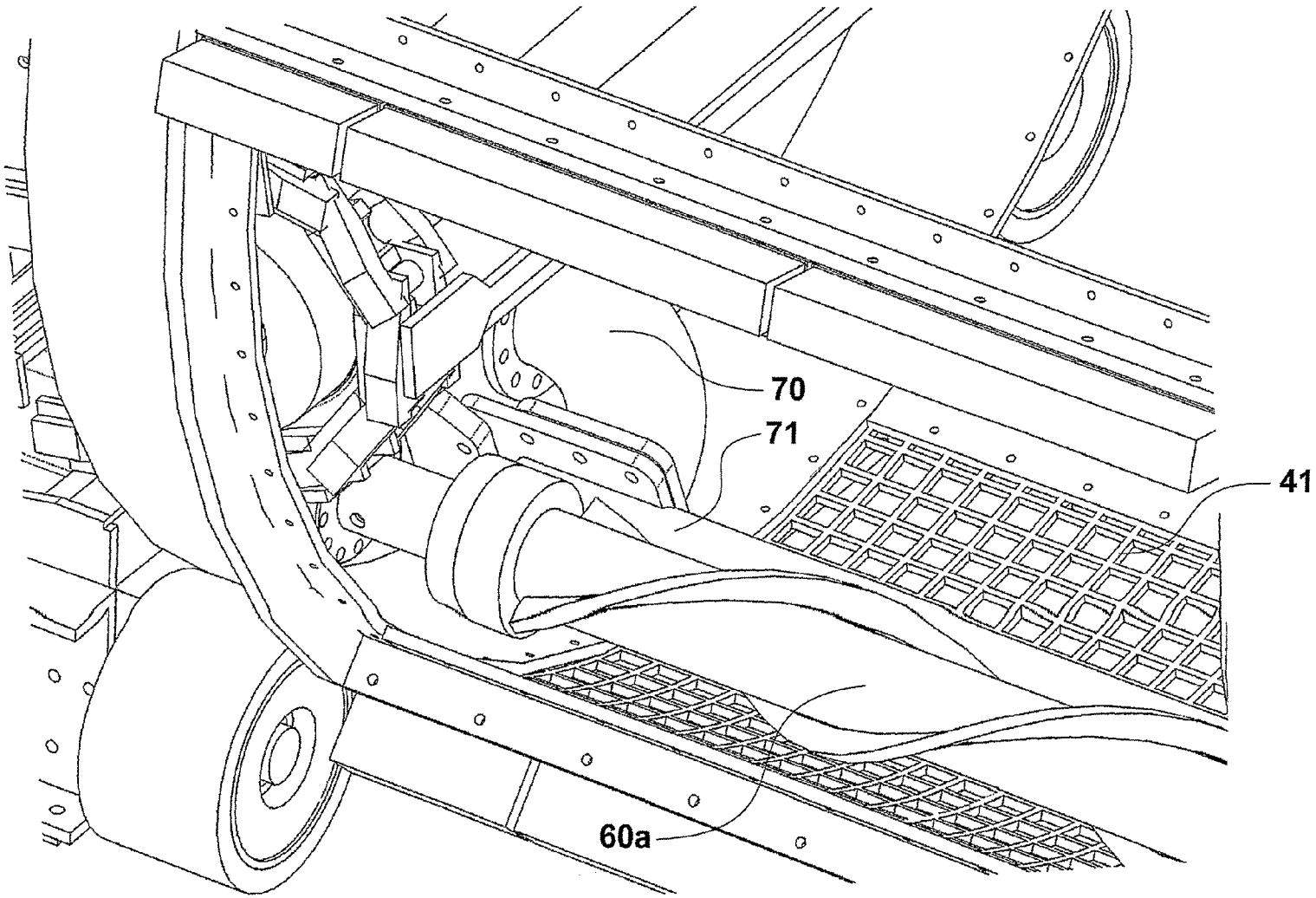
FIG. 8 is an alternate perspective of the region of FIG. 7.

Positioned at the lower end of the drum, and on the inside, is a rotating disc assembly (45) with a plurality of teeth (46) about its periphery. These may be fixed and/or swinging teeth (as known in the industry) The disc (45) is inclined in a number of manners. Referring to FIG. 6, which is a top plan view of the apparatus, the angling (nominally around 30°) of the disc with respect to the horizontal axis of the drum (40) is clearly visible. Mounting means (48) for holding the disc (45), and also transmitting drive from pulley (49) is also visible in FIG. 6. In FIG. 5 it can also be seen that the disc (45) is also angled downwardly with respect to the longitudinal axis of the drum (40). This angling corresponds to the deviation of the longitudinal axis of the drum (40) from the nominal horizontal (i.e. the ground), i.e. an angle of around 10°.

The interior of the drum (40) is divided into two sections by the inwardly directed flange (50). This extends by a height of approximately 50 mm inwardly of the inner surface of the drum. This section divides the drum into an initial cleaning section (55) and main processing section (56).

In practice, new unprocessed material as it enters the drum (40), will have a significant amount of dirt and foreign material shaken from it as it falls into the drum. The inwardly directed flange (50) acts as a barrier to prevent the majority of this material from entering into the subsequent processing section (56). The majority of this material will fall through the screen (57) associated with the cleaning section (55).

To further improve the efficiency of foreign material removal, agitating means in the form of shaft (60*b*) is provided in the cleaning section (55) to further agitate material.

Positioned about the periphery of the drum are a plurality of wiping blocks (62) with flexible blades and/or brushes which wipe clean the apertures of screening grates (57).

The agitating means (60*b*) is also part of an agitating means (60*a*) which extends through the processing section (56). While separate agitating means could be used, it has been found that it is simpler in design and efficiency to use a common shaft with helical screw blades thereabout. It can be clearly seen in FIG. 4 that the rotation orientation of the helical blades differs for the two sections.

In practice bulk material which finds its way into the processing section (56) will ultimately come into contact with the rotating disc (45). At this time reduction or comminution of at least part of the bulk material will occur. Typically also, the rotation of the disc will attempt to fling the processed material upwards and further up the drum towards the opening. This has a tendency to present the flung material against relatively clear sections of grate before it tumbles towards the bottom of the drum. This material, as it finds its way back down to the bottom end of the drum will, due to the rotational axis of the drum, typically follow a shark toothed or saw-tooth type pattern of movement if its path is traced from a view point at the front of the apparatus (e.g. FIG. 5). This motion tends to continually represent reduced material to fresh screening apertures to ensure that it has every possibility of escaping through the screen/grate if it is of sufficiently reduced size. This also reduces the possibility of large oversized material from continuously blocking the screen and thus preventing removal of the reduced size pieces. Additionally also, this tumbling motion within the apparatus continually re-orientates the various pieces of material. This can improve the screening process, as well as continually representing the material to the rotating disc (45) at different orientations, which may improve overall efficiency.

Further enhancing this tumbling process, and the screening process, is the presence of the agitating means (60*a*). The agitation thereby induced at the bottom portion of the rotating drum (40) can further increase the efficiency of screening. Accordingly, a number of different motions are being performed on the various material within the drum, and which are largely absent in the prior art which typically suffers from screening problems. It should also be associated that the degree of agitation and tumbling provided can be performed at a relatively slow speed, thereby minimising screen and component wear, but with good screening efficiency.

It has previously been mentioned in general section that a further advantage may be provided by also providing heating means. Here a manifold (70) is provided to direct exhaust from the combustion engine (driving a hydraulic pump) to a pipe (71) which then distributes exhaust gases along the length of the drum (40). In this example heat is radiated along the length of the pipe. In this example also, the majority of exhaust gases are vented into the cleaning section (55).

Figure 9:
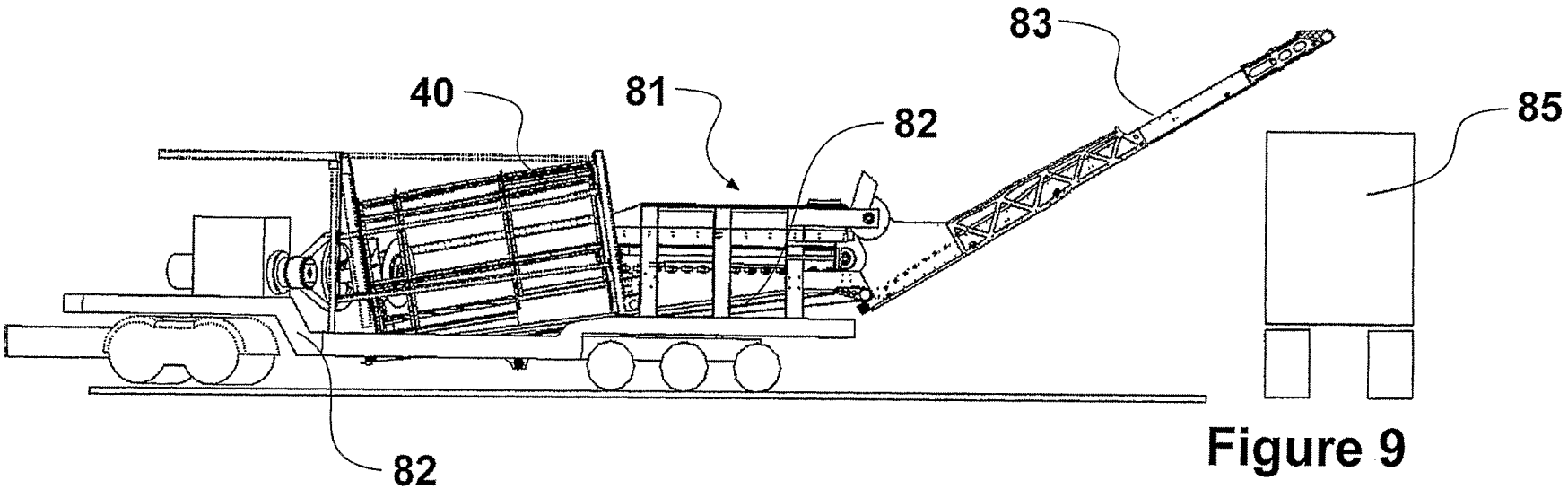
FIG. 9 is a front view of the full embodiment of FIG. 5 in an unfolded orientation.
Figure 10:
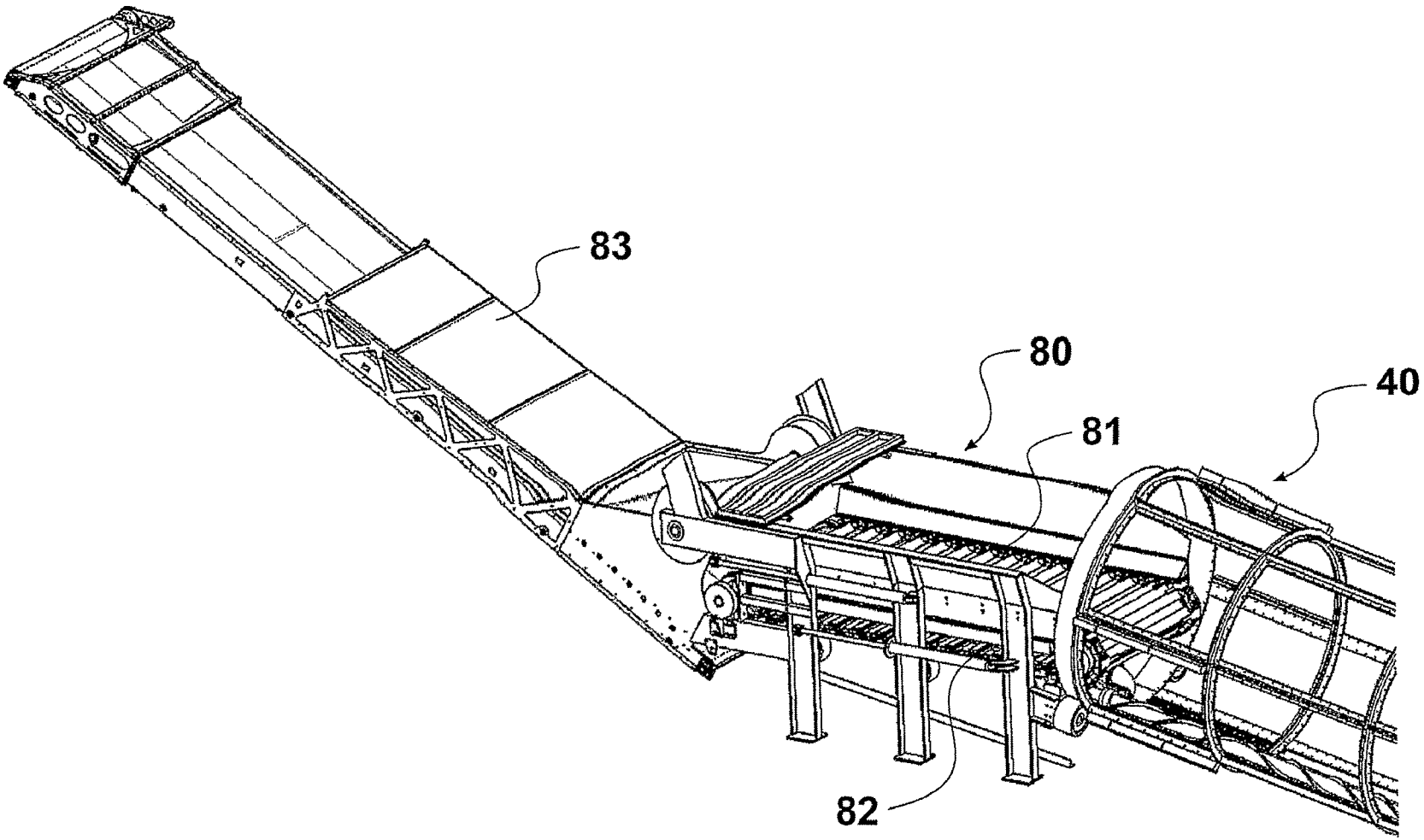
FIG. 10 is a perspective view showing the conveying portions of the embodiment of FIG. 5.

To assist loading and unloading of material into the apparatus, a dual conveyor system, generally indicated by arrow (80), has been proposed. This comprises an upper conveyor system (81) which feeds bulk material into the drum (40). Collecting screened material from underneath the apparatus is a secondary conveyor system (82) which feeds a loading conveyor (83) which can deliver screened material into a suitable hopper (85). The secondary conveying system (82) extends under substantially the entire length of the drum (40), as is partially visible in FIG. 9. It can also be seen that the loading conveyor system (83) pivots into position from its normal folded position (FIG. 5) to the extended position visible in FIG. 10.

The entire apparatus may be mounted on suitable trailer (88) which enables it to be moved from site to site. It is also envisaged that fixed, stationary embodiments may also be provided according to the present invention.

In practice raw material is loaded onto other conveyor (81). Typically this may be by excavator bucket, or front end loader bucket, or by grapple. This largely depends on the nature of the material being loaded. It is also possible that a conveyor system which leads onto feed conveyor (81) might be used in some embodiments.

Bulk material is then fed into the clockwise rotating drum (40) (when looking down the drum towards the disk) where it progresses through the cleaning section (55) and to processing section (56). As it encounters the rotating disc—typically from the left when looking down the drum towards the disc which is rotating anti-clockwise—it encounters the teeth and part of the material will be flung to the right and against the screen of the drum. Suitably reduced material may fall free at this stage or during further tumbling action due to the drum and counter-clockwise rotating agitating means, which also acts to force product further up the drum towards the feed end.

As material of suitably reduced size is produced and screened from the drum, it finds its way onto a lower conveyor (82). It is possible that additional screens and guides may be used to guide the material exiting from the screens of at least the processing section to fall onto lower conveyor system (82). Additionally, shielding associated with the cleaning section (55) may be provided to prevent foreign matter and material from falling onto the lower conveyor (82). Such additional external screens and guides may in fact divert removed material in the cleaning section to either side of the conveyor.

As the conveyor (82) removes reduced material from underneath the drum, it feeds it to further optional conveying means (83) which is able to load the material onto the back of a truck or hopper (85).

Aspects of the present invention have been described by way of example only and it should be appreciated that modifications and additions may be made thereto without departing from the spirit or scope of the present invention as described herein.

It should also be understood that the term "comprise" where used herein is not to be considered to be used in a limiting sense. Accordingly, 'comprise' does not represent nor define an exclusive set of items, but includes the possibility of other components and items being added to the list.

This specification is also based on the understanding of the inventor regarding the prior art. The prior art description should not be regarded as being authoritative disclosure on the true state of the prior art but rather as referencing considerations brought to the mind and attention of the inventor when developing this invention.

The claims defining the invention are:

1. Hogger apparatus comprising:

a drum inclined to the horizontal, being substantially open at its upper end to allow the feed of raw material therein, and including a rotating reducing means within and proximate the lower end of the drum, said reducing means bearing a plurality of features which interact and reduce the size of raw material with which it comes into contact, said reducing means being substantially a disc in shape;

the arrangement being further characterised in that at least a portion of the side wall of the drum exhibits a plurality of apertures acting as screening apertures to allow processed material of sufficiently reduced size to pass therethrough.

2. Hogger apparatus as claimed in claim 1 in which the rotational axis of the disc is angled, when the apparatus is viewed in top plan, at an angle to the longitudinal axis of the drum, said angle being within the inclusive range of 5°-75°.

3. Hogger apparatus as claimed in claim 2 in which the angle of the disc's rotational axis relative to the drum's longitudinal axis, when viewed in plan, is within the inclusive range of 25°-45°.

4. Hogger apparatus as claimed in claim 3 in which the rotational axis of the disc is angled, when the apparatus is viewed from the front, at an angle to the longitudinal axis of the drum, said angle being within the inclusive range of 5°-75°.

5. Hogger apparatus as claimed in claim 4 in which the angle of the disc's rotational axis relative to the drum's longitudinal axis, when viewed from the front, is within the inclusive range of 25°-45°.

6. Hogger apparatus as claimed in claim 1 in which the drum is rotatable and in which the rotating reducing means rotates in a direction opposite the direction of rotation of the drum.

7. Hogger apparatus as claimed in claim 1 in which, when viewed from an end of the drum, the disc is offset with respect to the longitudinal axis of the drum.

8. Hogger apparatus as claimed in claim 1 in which the features on the reducing assembly for reducing the raw material are teeth.

9. Hogger apparatus as claimed in claim 1 in which the drum is substantially cylindrical.

10. Hogger apparatus as claimed in claim 1 in which the screening apertures are present over substantially the entire outer surface of the drum, at least between the reducing means and the feed end of the drum.

11. Hogger apparatus as claimed in claim 1 in which the screening apertures are provided by replaceable screen sections attached to a framework of the drum.

12. Hogger apparatus as claimed in claim 1 in which differently sized screening apertures are provided on the drum.

13. Hogger apparatus as claimed in claim 1, in which the drum is divided into at least two sections, with an inwardly directed flange extending from the inner wall of the drum defining the boundary between different adjacent sections.

14. Hogger apparatus as claimed in claim 13 in which a first of said two sections adjacent the feed end of the drum is a cleaning section, and the other section, in which the reducing means is present, is a processing section for the reduction of introduced material; the inward flange acting as a barrier affecting the passage of small material from the first to the second processing section, said cleaning section prescreening, through screening apertures, introduced raw material from the feed end to separate small material comprising stones, dirt, and foreign material from the raw material.

15. Hogger apparatus as claimed in claim 14 in which the cleaning section includes one or more agitating means.

16. Hogger apparatus as claimed in claim 1 in which there is external wiping or brushing means for assisting the clearing and unblocking of foreign material from the screening apertures.

17. Hogger apparatus as claimed in claim 1 in which there is provided, adjacent the internal face of the drum, at least one rotating agitator to increase turbulence of the bulk raw and processed material in its vicinity.

18. Hogger apparatus as claimed in claim 17 in which a rotating agitator is a rotating shaft with a one or more blades or paddles thereabout and is rotated in a direction such that said rotating shaft with blades or paddles will attempt to push bulk material towards the feed end of the drum.

19. Hogger apparatus as claimed in claim 1 in which there is also provided at least one motive means for rotating the drum and reducing means, said motive means comprising one or more hydraulic motors.

20. Hogger apparatus as claimed in claim 19 in which the pump for the hydraulic motor is powered by a combustion engine.

21. Hogger apparatus as claimed in claim 20 in which the exhaust from the combustion engine is vented into the interior of the drum to heat, and partially dry, introduced raw material.

22. Hogger apparatus as claimed in claim 21 in which the exhaust is introduced by a pipe with venting apertures therein, which extends along at least part of the length of the drum.

23. Hogger apparatus as claimed in claim 1 in which there is an associated feed mechanism for delivering raw material into the drum, said feed mechanism comprising a conveyer arrangement.

24. Hogger apparatus as claimed in claim 1 which includes clearing means for transporting screened material away from the apparatus.

25. Hogger apparatus as claimed in claim 24 in which the clearing means comprises conveying means able to deliver transported material into a hopper, trailer, or storage area.

26. Hogger apparatus as claimed in claim 1 which includes both conveying feed means for introducing raw material into the drum, and clearing means; the conveying feed means positioned to be substantially over lower clearing means.

27. Hogger apparatus as claimed in claim 1 in which the raw material is predominantly wood based.

28. Hogger apparatus comprising:

a drum inclined to the horizontal, being substantially open at its upper end to allow the feed of raw material therein, and including a rotating reducing means within and proximate the lower end of the drum, said reducing means bearing a plurality of features which interact and reduce the size of raw material with which it comes into contact;

the arrangement being further characterised in that at least a portion of the side wall of the drum exhibits a plurality of apertures acting as screening apertures to allow processed material of sufficiently reduced size to pass therethrough;

at least one motive means for rotating the drum and reducing means, said motive means comprising one or more hydraulic motors, in which the pump for the hydraulic motor is powered by a combustion engine, and in which the exhaust from the combustion engine is vented into the interior of the drum to heat, and partially dry, introduced raw material.

29. Hogger apparatus as claimed in claim 28 in which the exhaust is introduced by a pipe with venting apertures therein, which extends along at least part of the length of the drum.

* * * * *